US008933852B2

(12) United States Patent
Wong et al.

(10) Patent No.: US 8,933,852 B2
(45) Date of Patent: Jan. 13, 2015

(54) MOBILE COMMUNICATION DEVICE AND ANTENNA STRUCTURE THEREIN

(75) Inventors: Kin-Lu Wong, New Taipei (TW); Yeh-Chun Kao, New Taipei (TW)

(73) Assignee: Acer Incorporated, Xizhi Dist., New Taipei (TW)

( * ) Notice: Subject to any disclaimer, the term of this patent is extended or adjusted under 35 U.S.C. 154(b) by 759 days.

(21) Appl. No.: 13/116,010

(22) Filed: May 26, 2011

(65) Prior Publication Data

US 2012/0262352 A1 Oct. 18, 2012

(30) Foreign Application Priority Data

Apr. 14, 2011 (TW) ..... 100112948 A

(51) Int. Cl.

| | |
|---|---|
| ***H01Q 21/00*** | (2006.01) |
| ***H01Q 1/24*** | (2006.01) |
| ***H01Q 5/00*** | (2006.01) |
| ***H01Q 7/00*** | (2006.01) |
| ***H01Q 9/42*** | (2006.01) |

(52) U.S. Cl.

CPC ..... *H01Q 1/243* (2013.01); *H01Q 5/0062* (2013.01); *H01Q 7/00* (2013.01); *H01Q 9/42* (2013.01)

USPC ..... 343/728; 343/725

(58) Field of Classification Search

USPC ..... 343/726–735

See application file for complete search history.

(56) References Cited

U.S. PATENT DOCUMENTS

| | | | | |
|---|---|---|---|---|
| 4,327,342 | A * | 4/1982 | De Ronde | 333/204 |
| 7,768,466 | B2 * | 8/2010 | Chi et al. | 343/741 |
| 2005/0078037 | A1 | 4/2005 | Leclerc | |
| 2009/0079657 | A1 * | 3/2009 | Chung et al. | 343/876 |
| 2009/0256763 | A1 | 10/2009 | Chi | |

FOREIGN PATENT DOCUMENTS

| | | | |
|---|---|---|---|
| CN | 1805215 | A | 7/2006 |
| FR | 2 860 927 | A1 | 4/2005 |
| JP | 10173425 | | 6/1998 |
| WO | 2010119999 | A1 | 10/2010 |

OTHER PUBLICATIONS

Yun-Wen Chi et al., "Internal Compact Dual-Band Printed Loop Antenna for Mobile Phone Application", IEEE Transactions on Antennas and Propagation,vol. 55, No. 5, May 2007, Digital Object Identifier: 10.1109/TAP.2007.895641 Publication Year: 2007, pp. 1457-1462.

Wei-Yu Li et al., "Internal penta-band printed loop-type mobile phone antenna", TENCON 2007—2007 IEEE Region 10 Conference Digital Object Identifier: 10.1109/TENCON.2007.4428859, Publication Year: 2007, pp. 1-4.

* cited by examiner

*Primary Examiner* — Matthew Mikels

(74) *Attorney, Agent, or Firm* — Winston Hsu; Scott Margo

(57) ABSTRACT

A mobile communication device includes an antenna structure which includes a grounding element and an antenna element. There is a notch at an edge of the grounding element. The antenna element is disposed in the notch and includes a metal loop portion and a monopole antenna. The metal loop portion is electrically connected to the grounding element with at least one shorting point, such that a short-circuited closed metal loop is formed. The monopole antenna has a first end and a second end, wherein the first end of the monopole antenna is a feeding point connected to a signal source, and the second end of the monopole antenna is an open end surrounded by the closed metal loop.

18 Claims, 5 Drawing Sheets

MOBILE COMMUNICATION DEVICE AND ANTENNA STRUCTURE THEREIN

BACKGROUND OF THE INVENTION

1. Field of the Invention

The present invention relates to a mobile communication device and an antenna structure therein, and more particularly, to a mobile communication device with a grounding element having a notch at an edge of the grounding element, wherein the notch is not located at a corner of the edge of the grounding element and a built-in multiband antenna is disposed in the notch for reducing influences resulted from the user's hand(s).

2. Description of the Prior Art

With the progress of wireless technology, mobile communication devices have become part of human's life. The living environment is filled with electromagnetic waves of different operating systems, hence the influence of the electromagnetic waves to the user has become an important topic, especially the mobile communication devices (such as, a mobile phone or a tablet PC) which generally contact with the user for a long time in daily life. On the other hand, the influence resulted from the user's hand to the characteristics of the built-in antenna of the mobile communication device has become another important topic in this field. For example, in the prior art, such as U.S. Pat. No. 7,768,466 B2 with the invention entitled "Multiband folded loop antenna", a mobile communication device with a multiband loop antenna has been disclosed. The loop antenna is disposed on an edge of the ground plane and occupies the whole edge to achieve the wideband operation. However, such an antenna configuration cannot be closely integrated with the adjacent ground plane, and may lead to waste of the valuable internal space of the device. In addition, when the mobile communication device is in use by the user, the characteristics of the antenna may be easily affected by the user's different hand grips since the user's hand is closer to the antenna.

Hence, how to provide a mobile communication device with two wide operating bands at least covering from about 824 MHz to 960 MHz and from about 1710 MHz to 2710 MHz to satisfy the penta-band WWAN (wireless wide area network) operation has become an important topic in this field. In addition, the antenna can be disposed on a ground plane with a notch, which is located near a middle region of an edge of the ground plane for increasing the distance between the user's hand and the antenna, such that the influence caused by the user's hand to the antenna can be reduced in order to solve the above-mentioned problems existed in the prior art.

SUMMARY OF THE INVENTION

In order to solve the abovementioned problems, it is one of the objectives of the present invention to provide a mobile communication device and a related antenna structure for reducing influences resulted from the user's hand(s).

According to an aspect of the present invention, a mobile communication device comprising an antenna structure is provided. The antenna structure includes a grounding element and an antenna element. There is a notch at an edge of the grounding element, and the antenna element is disposed in the notch of the grounding element. The antenna element may include a metal loop portion and a monopole antenna. The metal loop portion is electrically connected to the grounding element with at least one shorting point, such that a closed metal loop is formed by the metal loop portion and the grounding element. The monopole antenna has a first end and a second end, wherein the first end of the monopole antenna is a feeding point connected to a signal source, and the second end of the monopole antenna is an open end surrounded by the closed metal loop.

The antenna element has a first operating band and a second operating band. A resonant path length of the metal loop portion is about 0.5 wavelength of a center frequency of the first operating band, which can contribute a resonant mode to form the first operating band. A resonant path length of the monopole antenna is about 0.25 wavelength of a center frequency of the second operating band, which can contribute a resonant mode to combine with a higher-order resonant mode of the metal loop portion in order to from the second operating band. Each of the first operating band and the second operating band can cover at least one operating band of telecommunication protocols at present.

According to an aspect of the present invention, an antenna structure is provided. The antenna structure includes a grounding element and an antenna element. There is a notch at an edge of the grounding element, and the antenna element is disposed in the notch of the grounding element. The antenna element may include a metal loop portion and a monopole antenna. The metal loop portion is electrically connected to the grounding element with at least one shorting point, such that a closed metal loop is formed by the metal loop portion and the grounding element. The monopole antenna has a first end and a second end, wherein the first end of the monopole antenna is a feeding point connected to a signal source, and the second end of the monopole antenna is an open end surrounded by the closed metal loop.

According to one embodiment of the present invention, the metal loop portion at least includes an inner U-shaped section and an outer U-shaped section in order to form the closed metal loop with a double U-shape. Be noted that the second end of the monopole antenna is located inside the inner U-shaped section of the metal loop portion and is surrounded by the inner U-shaped section.

In one embodiment of the present invention, the notch may be located near a middle region of the edge of the grounding element. In another embodiment of the present invention, the notch is located at a corner of the edge of the grounding element.

In one embodiment of the present invention, the antenna element is a three-dimensional structure, and the antenna element and the grounding element are located on different planes of a three-dimensional space. In another embodiment of the present invention, the antenna element is a planar structure, and the antenna element and the grounding element are located on a same plane of a three-dimensional space.

The mobile communication device and its antenna structure of the present disclosure uses a metal loop portion to form a closed metal loop, such that the coupling effects caused by the antenna and the grounding element or the surroundings are reduced. In the meanwhile, the open end of monopole antenna is surrounded by the metal loop portion for reducing the coupling effects of the monopole antenna and the grounding element or the surroundings. As a result, the antenna element can be closely integrated with the adjacent grounding element and can have low near-field radiation characteristics. In addition, since the antenna element is surrounded by the notch of the grounding element, the coupling effects resulted from the user's hand and the antenna element is smaller when the mobile communication device is in use by a user, such that the influence to the antenna element becomes smaller.

Besides, such an antenna has a simple structure and can be manufactured easily, which can satisfy the requirements of practical applications.

These and other objectives of the present invention will no doubt become obvious to those of ordinary skill in the art after reading the following detailed description of the preferred embodiment that is illustrated in the various figures and drawings.

DETAILED DESCRIPTION

The following description is of the best-contemplated mode of carrying out the present invention. A detailed description is given in the following embodiments with reference to the accompanying drawings.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
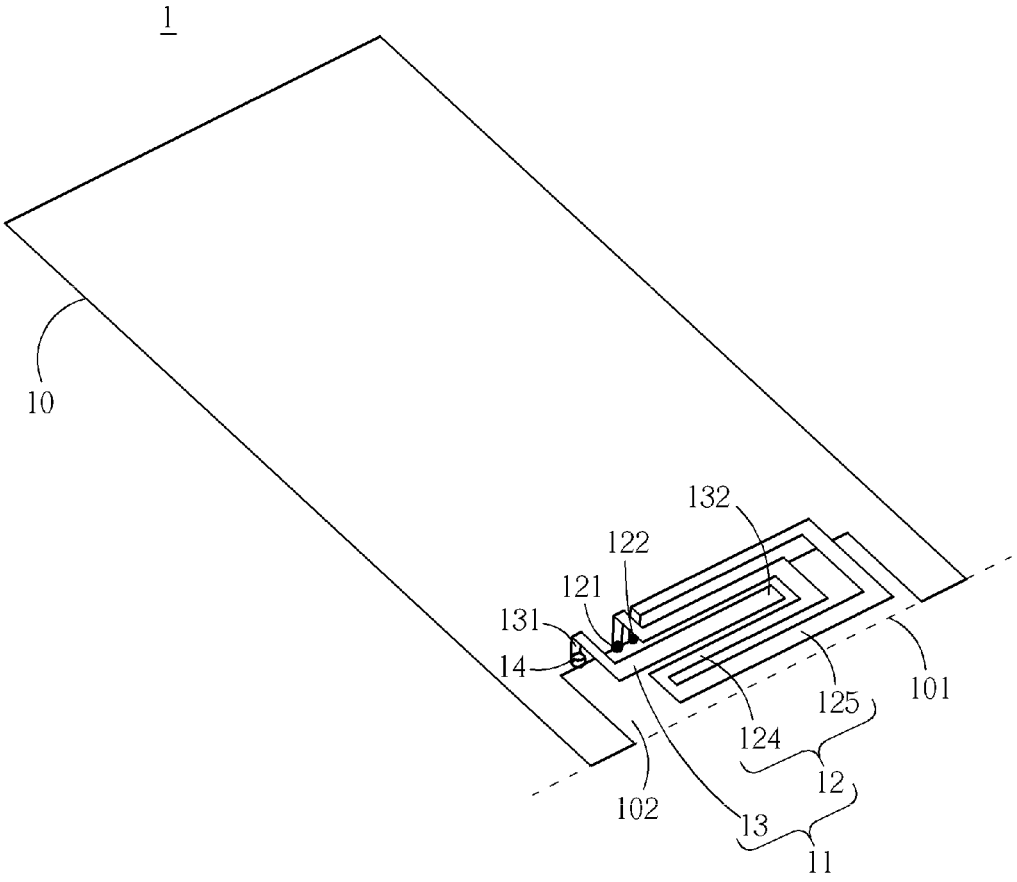
FIG. 1 is a diagram illustrating a mobile communication device and an antenna structure disposed therein according to a first embodiment of the present invention.

Please refer to FIG. 1. FIG. 1 is a diagram illustrating a mobile communication device 1 and an antenna structure disposed therein according to a first embodiment of the present invention. As shown in FIG. 1, the mobile communication device 1 includes an antenna structure, wherein the antenna structure may include, but is not limited to, a grounding element 10 and an antenna element 11. There is a notch 102 at an edge 101 of the grounding element 10, and the antenna element 11 is disposed in the notch 102 of the grounding element 10. In this embodiment, the antenna element 11 may include a metal loop portion 12 and a monopole antenna 13, wherein the metal loop portion 12 is electrically connected to the grounding element 10 with at least shorting points 121 and 122, such that a closed metal loop is formed by the metal loop portion 12 and the grounding element 10. Be noted that the antenna element 11 has a first operating band and a second operating band, wherein a resonant path length of the metal loop portion 12 is about 0.5 wavelength of a center frequency of the first operating band of the antenna element 11. The monopole antenna 13 has a first end 131 and a second end 132, wherein the first end 131 of the monopole antenna 13 is a feeding point connected to a signal source 14, and the second end 132 of the monopole antenna 13 is an open end surrounded by the closed metal loop being formed by the metal loop portion 12. Be noted that a resonant path length of the monopole antenna 13 is about 0.25 wavelength of a center frequency of the second operating band.

What calls for special attention is that: in this embodiment, the metal loop portion 12 at least includes an inner U-shaped section 124 and an outer U-shaped section 125 in order to form the closed metal loop with a double U-shape. The second end 132 of the monopole antenna 13 is located inside the inner U-shaped section 124 of the metal loop portion 12 and is surrounded by the inner U-shaped section 124.

Furthermore, the monopole antenna 13 may further includes at least one bending for reducing the whole size of the antenna element 11, but this in no way should be considered as a limitation of the present invention. Those skilled in the art should appreciate that: the number of the bendings of the metal loop portion 12 and the monopole antenna 13 is not limited, and the bending direction, the bending angle, and the bending shape of the bendings should not be considered as a limitation of the present invention.

Figure 2:
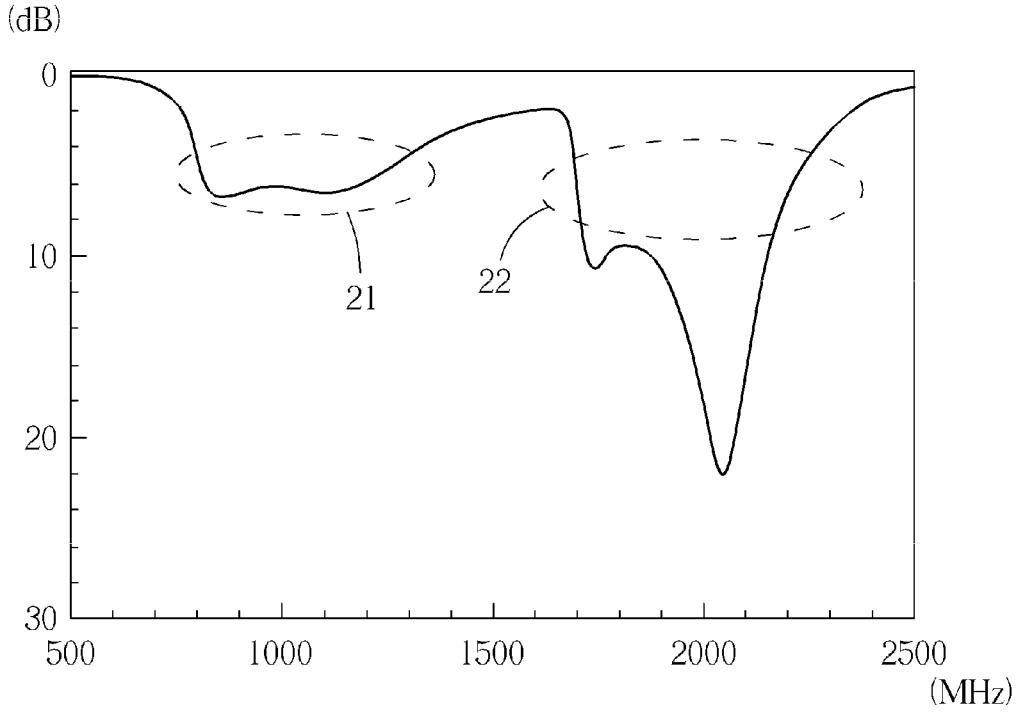
FIG. 2 is a diagram illustrating the return loss of the mobile communication device and the antenna structure disposed therein according to a first embodiment of the present invention.

Please refer to FIG. 2 together with FIG. 1. FIG. 2 is a diagram illustrating the return loss of the mobile communication device 1 and the antenna structure disposed therein according to a first embodiment of the present invention. In this embodiment, the size of the mobile communication device 1 is as follows: the grounding element 10 has a length of 100 mm and a width of 60 mm; the notch 102 has a length of 43 mm and a width of 10 mm, and is located near a middle region of the edge of the grounding element 10; the monopole antenna 13 has a length of 36 mm; and the metal loop portion 12 has a length of 150 mm. According to the experimental results and a 6-dB return-loss definition, the first operating band 21 of the mobile communication device 1 and its antenna structure may cover the dual-band GSM850/900 operation (from about 824 MHz to 960 MHz), and the second operating band 22 may cover the triple-band GSM1800/GSM1900/UMTS operation (from about 1710 MHz to 2170 MHz), thereby the antenna structure can satisfy requirements of the penta-band WWAN operation. Moreover, in this embodiment, the metal loop portion 12 is excited through the monopole antenna 13 for generating a half-wavelength resonant mode at the lower frequencies (such as, 860 MHz nearby) in order to form the wide first operating band 21 at least covering from about 824 MHz to 960 MHz, and for generating a higher-order resonant mode at the higher frequencies (such as, 1740 MHz nearby). Then, the higher-order resonant mode can combine with a quarter-wavelength resonant mode generated by the monopole antenna 13 at the higher frequencies (such as, 200 MHz nearby) to form the wide second operating band 22 at least covering from about 1710 MHz to 2170 MHz. Be noted that: the metal loop portion 12 forms a closed metal loop for reducing coupling effects resulted from the grounding element 10 or surroundings. In the meanwhile, the second end 132 (i.e., the open end) of the monopole antenna 13 is surrounded by the metal loop portion 12, which can reduce the coupling effects caused by the monopole antenna 13 and the grounding element 10 or surroundings. As a result, the antenna element 11 can be closely integrated with the adjacent grounding element 10 and can have low near-field radiation characteristics. In addition, since the antenna element 11 is surrounded by the notch 102 of the grounding element 10, the coupling effects resulted from the user's hand and the antenna element 11 is smaller when the mobile communication device 1 is in use by a user, such that the influence to the antenna element 11 becomes smaller. Such an antenna has a simple structure and can be manufactured easily, which can satisfy the requirements of practical applications.

Figure 3:
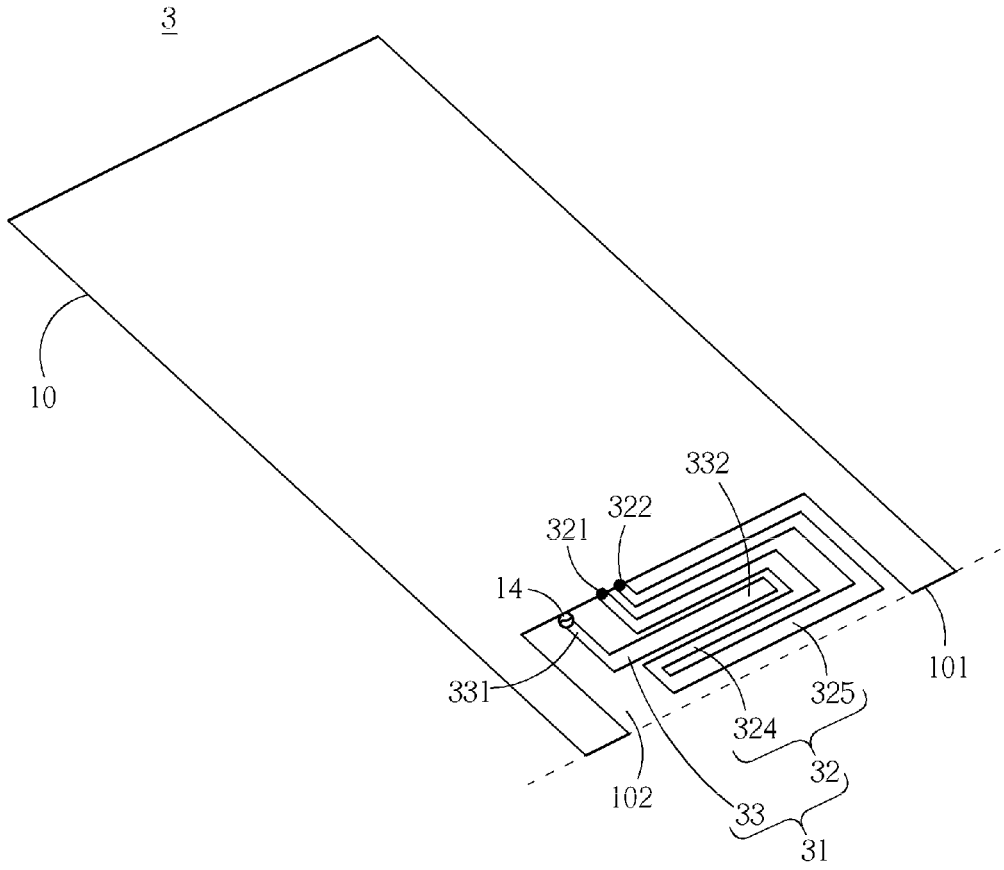
FIG. 3 is a diagram illustrating a mobile communication device and an antenna structure disposed therein according to a second embodiment of the present invention.

Please refer to FIG. 3. FIG. 3 is a diagram illustrating a mobile communication device 3 and an antenna structure disposed therein according to a second embodiment of the present invention. The structure of the mobile communication device 3 shown in the second embodiment is similar to that of the mobile communication device 1 shown in the first embodiment, and the difference between them is that: an antenna element 31 (including an metal loop portion 32 and a monopole antenna 33, and the metal loop portion 32 at least including an inner U-shaped section 324 and an outer U-shaped section 325) of the mobile communication device 3 can be implemented by a planar structure in order to reduce the manufacturing cost. In order words, in the first embodiment, the antenna element 11 of the mobile communication device 1 is implemented by a three-dimensional structure, wherein the antenna element 11 and the grounding element 10 are located on different planes of the three-dimensional space; in the second embodiment, the antenna element 31 of the mobile communication device 3 is implemented by a planar structure, wherein the antenna element 31 and the grounding element 10 are located on a same plane of the three-dimensional space.

Figure 4:
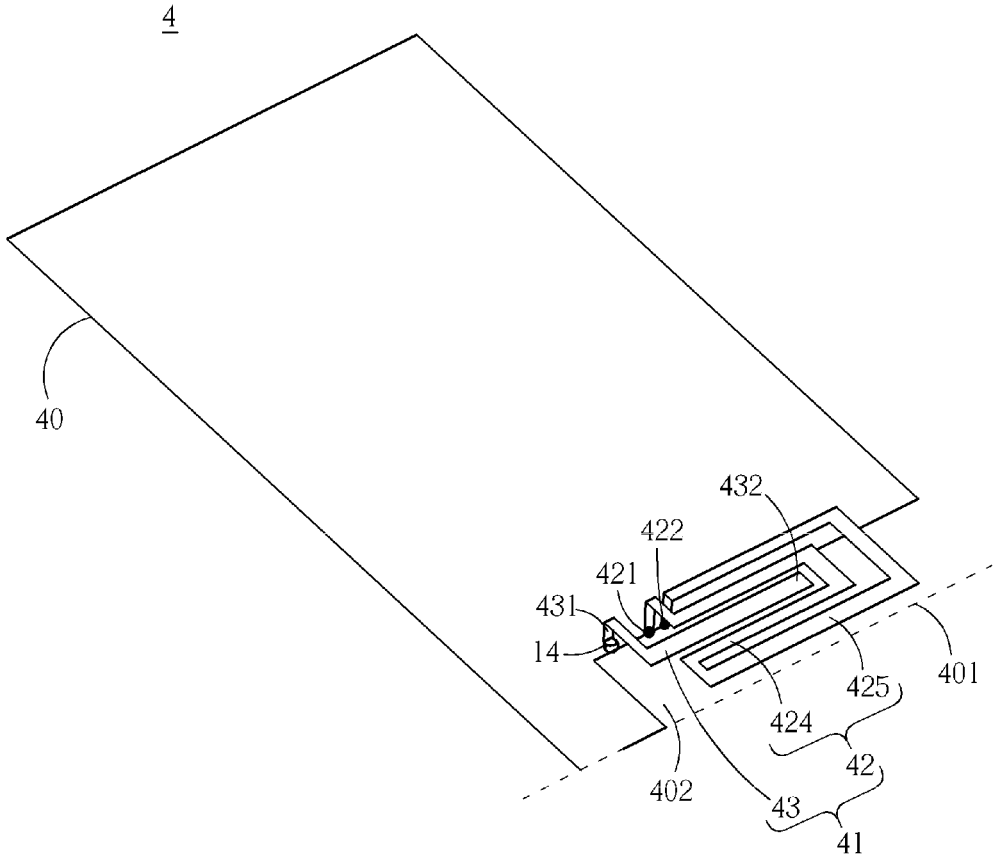
FIG. 4 is a diagram illustrating a mobile communication device and an antenna structure disposed therein according to a third embodiment of the present invention.

Please refer to FIG. 4. FIG. 4 is a diagram illustrating a mobile communication device 4 and an antenna structure disposed therein according to a third embodiment of the present invention. The structure of the mobile communication device 4 shown in the third embodiment is similar to that of the mobile communication device 1 shown in the first embodiment, and the difference between them is that: a notch 402 of the grounding element 40 of the mobile communication device 4 is located at a corner of the edge 401 of the grounding element 40. At this time, the antenna element 41 (including a metal loop portion 42 and a monopole antenna 43, and the metal loop portion 42 at least including an inner U-shaped section 424 and an outer U-shaped section 425) is not surrounded by the adjacent grounding element 40, therefore, it's much easier to achieve the wideband or multiband antenna operation. In other words, in the first embodiment, the notch 102 of the grounding element 10 of the mobile communication device 1 is located near a middle region of the edge 101 of the grounding element 10, and the antenna element 11 is surrounded by the grounding element 10; however, in the third embodiment, the notch 402 of the grounding element 40 of the mobile communication device 4 is located at a corner of the edge 401 of the grounding element 40, and the antenna element 41 is not surrounded by the grounding element 40.

Figure 5:
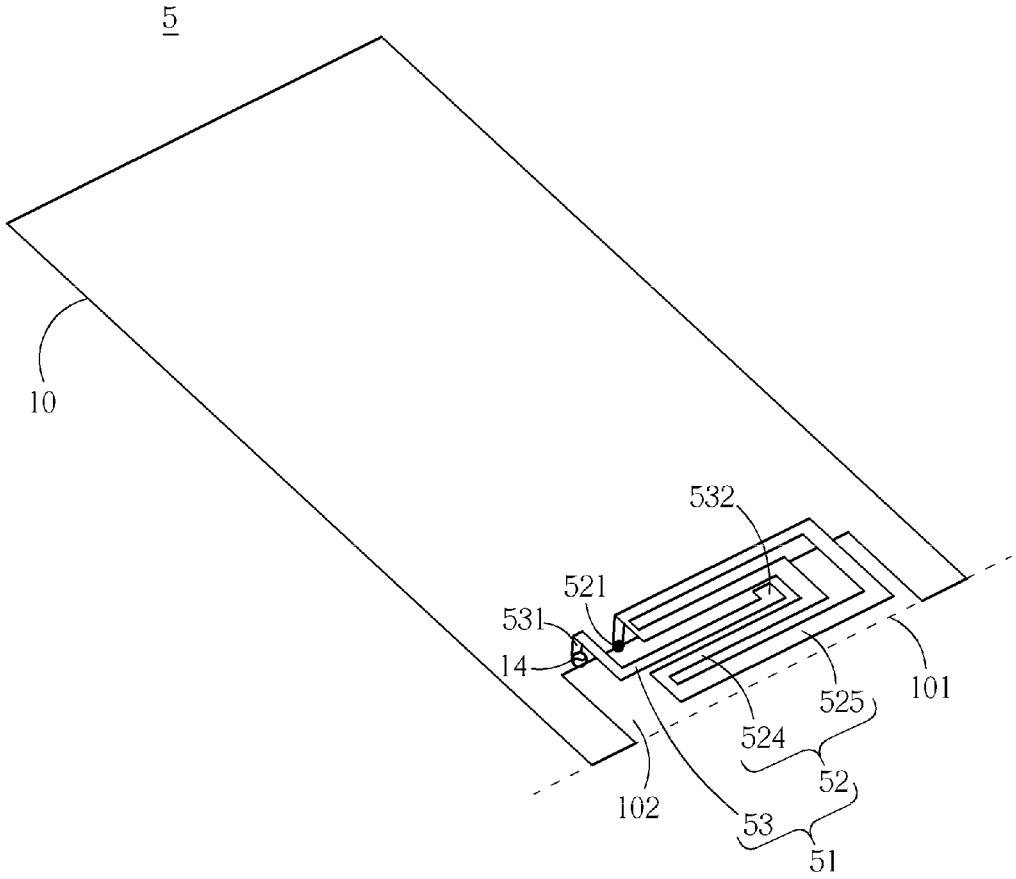
FIG. 5 is a diagram illustrating a mobile communication device and an antenna structure disposed therein according to a fourth embodiment of the present invention.

Please refer to FIG. 5. FIG. 5 is a diagram illustrating a mobile communication device 5 and an antenna structure disposed therein according to a fourth embodiment of the present invention. The structure of the mobile communication device 5 shown in the fourth embodiment is similar to that of the mobile communication device 1 shown in the first embodiment, and the difference between them is that: a second end 532 (i.e., the open end) of a monopole antenna 53 of the antenna element 51 in the mobile communication device 5 shown in FIG. 5 includes a bending, and the metal loop portion 52 (including an inner U-shaped section 524 and an outer U-shaped section 525) is electrically connected to the grounding element 10 with a single shorting point 521. In other words, the number of the shorting point(s) electrically connected between the metal loop portion and the grounding element should not be considered as the limitations of the present invention. In addition, the number of the bending(s) of the monopole antenna is not limited, and the bending direction, the bending angle, and the bending shape of the bendings should not be considered as a limitation of the present invention.

Please note that: since each of the structure of the mobile communication device 3 of the second embodiment, the mobile communication device 4 of the third embodiment, and the mobile communication device 5 of the fourth mobile communication device 5 is similar to that of the mobile communication device 1 of the first embodiment, and can form two similar wide operating bands covering the penta-band WWAN operation.

Undoubtedly, those skilled in the art should appreciate that various modifications of the mobile communication devices and the antenna structures shown in FIG. 1, FIG. 3, FIG. 4, and FIG. 5 may be made without departing from the spirit of the present invention. In addition, the number of the bendings of the metal loop portion and the monopole antenna is not limited, and the bending direction, the bending angle, and the bending shape of the bendings should not be considered as a limitation of the present invention.

The abovementioned embodiments are presented merely to illustrate practicable designs of the present invention, and in no way should be considered to be limitations of the scope of the present invention. In summary, a mobile communication device and its antenna structure are provided, which include an antenna element capable of forming two wide operating bands. Such an antenna has a simple structure and has low near-field radiation characteristics. Therefore, the coupling effects resulted from the user's hand and the antenna element is smaller when the mobile communication device is in use by a user. Besides, the two operating bands of the antenna element may cover the dual-band GSM850/900 operation (from about 824 MHz to 960 MHz) and the triple-band GSM1800/1900/UMTS operation (from about 1710 MHz to 2179 MHz), respectively, thereby covering the penta-band WWAN operation.

While the present invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

Those skilled in the art will readily observe that numerous modifications and alterations of the device and method may be made while retaining the teachings of the invention.

What is claimed is:

1. A mobile communication device, comprising an antenna structure, the antenna structure comprising:

a grounding element, wherein there is a notch at an edge of the grounding element; and an antenna element, disposed in the notch of the grounding element, the antenna element comprising:

a metal loop portion, wherein the metal loop portion is electrically connected to the grounding element with at least one shorting point, such that a closed metal loop is formed by the metal loop portion and the grounding element; and a monopole antenna, having a first end and a second end, wherein the first end of the monopole antenna is a feeding point connected to a signal source, and the second end of the monopole antenna is an open end surrounded by the closed metal loop;

wherein the antenna element comprises a first operating band and a second operating band, and a resonant path length of the monopole antenna is about 0.25 wavelength of a center frequency of the second operating band; and a resonant path length of the metal loop portion is about 0.5 wavelength of a center frequency of the first operating band.

2. The mobile communication device according to claim 1, wherein the metal loop portion at least comprises an inner U-shaped section and an outer U-shaped section in order to form the closed metal loop with a double U-shape.

3. The mobile communication device according to claim 2, wherein the second end of the monopole antenna is located inside the inner U-shaped section of the metal loop portion and is surrounded by the inner U-shaped section.

4. The mobile communication device according to claim 1, wherein the first operating band covers from about 824 MHz to 960 MHz, and the second operating band covers from about 1710 MHz to 2170 MHz.

5. The mobile communication device according to claim 1, wherein the monopole antenna comprises at least one bending.

6. The mobile communication device according to claim 1, wherein the notch is located near a middle region of the edge of the grounding element.

7. The mobile communication device according to claim 1, wherein the notch is located at a corner of the edge of the grounding element.

8. The mobile communication device according to claim 1, wherein the antenna element is a three-dimensional structure, and the antenna element and the grounding element are located on different planes of a three-dimensional space.

9. The mobile communication device according to claim 1, wherein the antenna element is a planar structure, and the antenna element and the grounding element are located on a same plane of a three-dimensional space.

10. An antenna structure, comprising:

a grounding element, wherein there is a notch at an edge of the grounding element; and an antenna element, disposed in the notch of the grounding element, the antenna element comprising:

a metal loop portion, wherein the metal loop portion is electrically connected to the grounding element with at least one shorting point, such that a closed metal loop is formed by the metal loop portion and the grounding element; and a monopole antenna, having a first end and a second end, wherein the first end of the monopole antenna is a feeding point connected to a signal source, and the second end of the monopole antenna is an open end surrounded by the closed metal loop;

wherein the antenna element comprises a first operating band and a second operating band, and a resonant path length of the monopole antenna is about 0.25 wavelength of a center frequency of the second operating band; and a resonant path length of the metal loop portion is about 0.5 wavelength of a center frequency of the first operating band.

11. The antenna structure according to claim 10, wherein the metal loop portion at least comprises an inner U-shaped section and an outer U-shaped section in order to form the closed metal loop with a double U-shape.

12. The antenna structure according to claim 11, wherein the second end of the monopole antenna is located inside the inner U-shaped section of the metal loop portion and is surrounded by the inner U-shaped section.

13. The antenna structure according to claim 10, wherein the antenna element comprises a first operating band and a second operating band, the first operating band covers from about 824 MHz to 960 MHz, and the second operating band covers from about 1710 MHz to 2170 MHz.

14. The antenna structure according to claim 10, wherein the monopole antenna comprises at least one bending.

15. The antenna structure according to claim 10, wherein the notch is located near a middle region of the edge of the grounding element.

16. The antenna structure according to claim 10, wherein the notch is located at a corner of the edge of the grounding element.

17. The antenna structure according to claim 10, wherein the antenna element is a three-dimensional structure, and the antenna element and the grounding element are located on different planes of a three-dimensional space.

18. The antenna structure according to claim 10, wherein the antenna element is a planar structure, and the antenna element and the grounding element are located on a same plane of a three-dimensional space.

* * * * *